US006968786B2

(12) United States Patent
Theurer

(10) Patent No.: US 6,968,786 B2
(45) Date of Patent: Nov. 29, 2005

(54) TAMPING TOOL UNIT FOR TAMPING BALLAST

(75) Inventor: Josef Theurer, Vienna (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 129 days.

(21) Appl. No.: 10/779,029

(22) Filed: Feb. 13, 2004

(65) Prior Publication Data

US 2004/0163566 A1 Aug. 26, 2004

(30) Foreign Application Priority Data

Feb. 24, 2003 (AT) ..... GM114/2003

(51) Int. Cl.[7] ..... E01B 27/00
(52) U.S. Cl. ..... 104/12
(58) Field of Search ..... 104/2, 10, 12, 104/13; 37/104

(56) References Cited

U.S. PATENT DOCUMENTS

| | | | | |
|---|---|---|---|---|
| 3,396,671 A * | 8/1968 | Roseberry | ..... | 104/13 |
| 4,576,095 A | 3/1986 | Theurer | | |
| 4,598,645 A * | 7/1986 | Ganz | ..... | 104/12 |
| 4,773,333 A * | 9/1988 | Theurer | ..... | 104/12 |

* cited by examiner

*Primary Examiner*—Mark T. Le
(74) *Attorney, Agent, or Firm*—Collard & Roe, P.C.

(57) ABSTRACT

A tamping tool unit for tamping ballast under a respective one of a succession of ties of a railroad track comprises a frame extending in a longitudinal direction, a pair of tamping tool levers mounted on the frame for pivoting about pivot axes in a plane extending in the longitudinal direction, a reciprocating drive connected to each tamping tool lever for pivoting the tamping tool lever, and a tamping pick at a lower end of each tamping tool lever. A guide on at least one of the tamping tool levers is provided for displacing the tamping pick in a direction extending perpendicularly to the pivot axis of the at least one tamping tool lever, and a fixing device is provided for fixing the tamping pick on the lower tamping tool lever end.

4 Claims, 2 Drawing Sheets

Fig.4
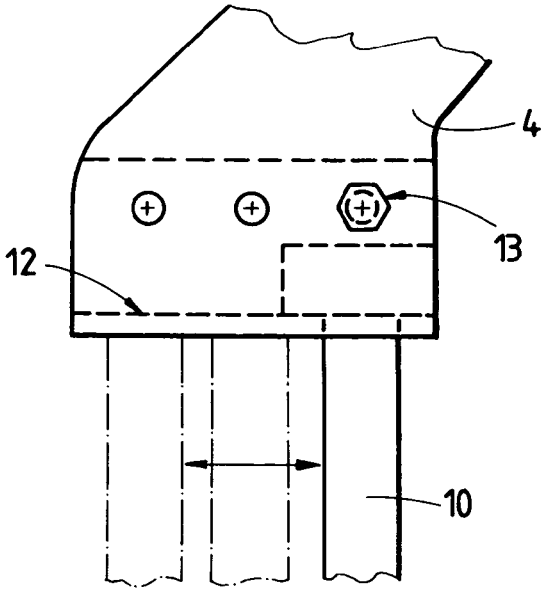
Fig.5
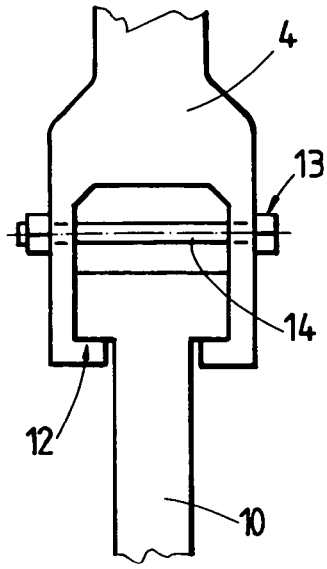
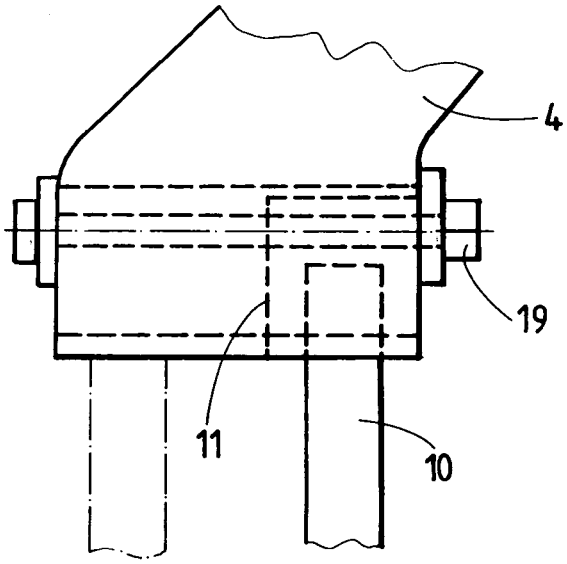
Fig. 6

TAMPING TOOL UNIT FOR TAMPING BALLAST

BACKGROUND OF THE INVENTION

1. Field of the Invention

The present invention relates to a tamping tool unit for tamping ballast under a respective one of successive ties of a railroad track, which comprises a frame extending in a frame extending in a longitudinal direction, a pair of tamping tool levers mounted on the frame for pivoting about a pivot axis in a plane extending in the longitudinal direction, a reciprocating drive connected to each tamping tool lever for pivoting the tamping tool lever, and a tamping pick at a lower end of each tamping tool lever.

2. Description of the Prior Art

Such tamping tool units are well known, and U.S. Pat. No. 4,576,095 discloses such a tamping tool unit wherein the opening width of a pair of reciprocating tamping tool levers may be selectively varied, which may be necessary, for example, if a double tie is to be tamped by the pair of reciprocating tamping tool levers. For this purpose, a stop pivotal into engagement with the piston rod of the reciprocating drive may be actuated to change the reciprocating path. In this way, the tamping tool unit may be adapted to different crib widths.

In the tamping of ballast under successive ties of a railroad track, the crib width, i.e. the distance of the ties from each other, is of essential importance. If, for instance, a track to be tamped changes from wooden to concrete ties, the resultant change in the crib width causes considerable problems in a continuous track tamping operation. Normally, this has required a different tamping unit whose tamping picks are adapted to the changed crib width.

SUMMARY OF THE INVENTION

It is the primary object of this invention to provide a tamping tool unit of the first-indicated type which simplifies the tamping of track sections having different crib widths.

This and other objects are accomplished according to the invention with a tamping tool unit of the first-described structure, which has a guide on at least one of the tamping tool levers for displacing the tamping pick in a direction extending perpendicularly to the pivot axis, and a fixing device for fixing the tamping pick on the lower tamping tool lever end. A tamping pick carrier may be provided on at least one of the tamping tool levers, which is displaceable along a guide relative to the at least one tamping tool lever in a direction extending perpendicularly to the pivot axis.

This enables the tamping tool unit to be retrofitted simply and in a minimum of time by displacing the tamping pick or its carrier in the longitudinal direction of the tamping tool unit frame along the guide, and then fixing it on the tamping tool lever in the displaced position. This enables the reciprocation of the pair of tamping tool levers to be readily adapted to a changed crib width. Accordingly, track sections having different crib widths may be readily tamped in a continuous tamping operation with the same tamping tool unit.

BRIEF DESCRIPTION OF THE DRAWING

The above and other objects, advantages and features of the present invention will become more apparent from the following detailed description of certain now preferred embodiments, taken in conjunction with the accompanying, somewhat schematic drawing wherein

FIGS. 4 to 6 are other enlarged, fragmentary views showing various embodiments.

DETAILED DESCRIPTION OF THE PREFERRED EMBODIMENTS

Figure 1:
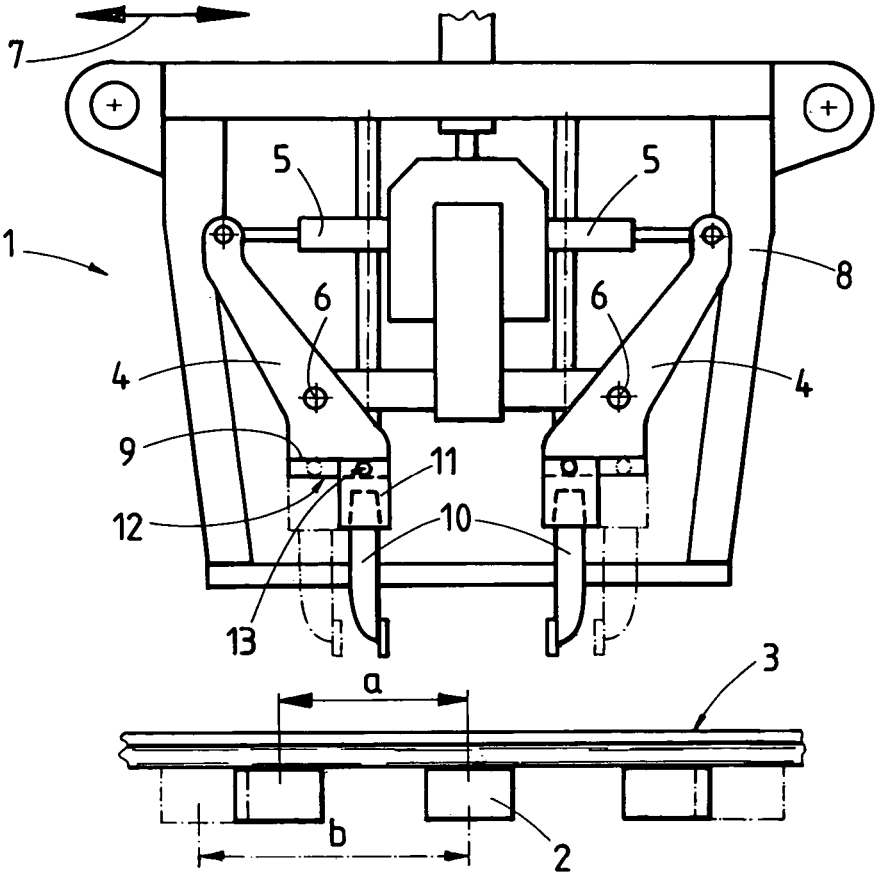
FIG. 1 is a side elevational view of a tamping tool unit according to this invention.

FIG. 1 illustrates tamping tool unit 1 for tamping ballast under a respective one of a succession of ties 2 of railroad track 3. The tamping tool unit comprises frame 8 extending in a longitudinal direction indicated by arrow 7, and a pair of tamping tool levers 4 mounted on frame 8 for pivoting about pivot axes 6 in a plane extending in the longitudinal direction. Each pivot axis extends in the longitudinal direction of ties 2. A reciprocating drive 5 is connected to each tamping tool lever 4 for pivoting the tamping tool lever, and tamping pick 10 is provided at lower end 9 of each tamping tool lever. Guide 12 on at least one of the tamping tool levers 4 is provided for displacing tamping pick 10 in a direction extending perpendicularly to pivot axis 6. Fixing device 13 is provided for fixing tamping pick 10 on lower tamping tool lever end 9.

As shown in FIGS. 4 and 5, a specially designed tamping pick 10 may be guided directly in guide 12 at end 9 of tamping tool lever 4, and fixing device 13 fixes the tamping pick directly to the tamping tool lever.

Figure 2:
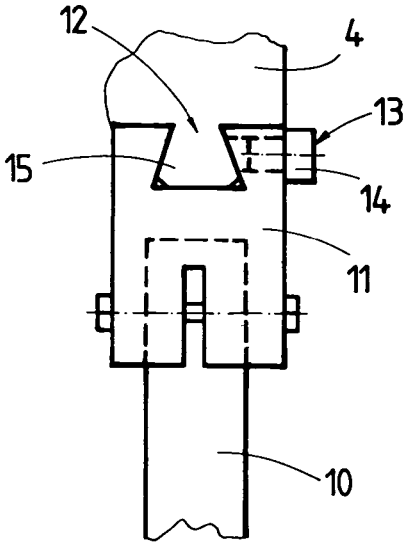
FIGS. 2 and 3 are enlarged, fragmentary views showing some details of a tamping pick guide.
Figure 3:
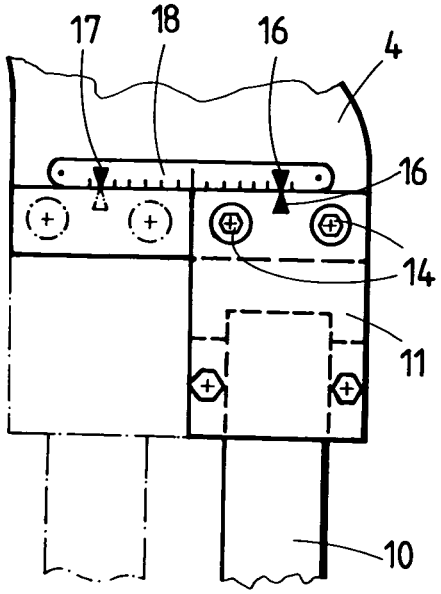

In the embodiments shown in FIGS. 2, 3 and 6, tamping pick 10 is mounted on tamping pick carrier 11 on tamping tool levers 4 and this carrier is displaceable along guide 12 relative to the at least one tamping tool lever 4 in a direction extending perpendicularly to pivot axis 6.

The preferred fixing device comprises screws 14 extending in the direction of pivot axis 6, as shown in FIGS. 2 and 3. In operation, when a tamper reaches a point along the railroad track where the crib width changes, screws 14 are loosened, tamping pick 10 is displaced in the longitudinal direction of tamping tool carrier 8, which is the direction of rails 2, and the screws are then tightened to hold the tamping tool pick in the displaced position. As shown in FIG. 1, a smaller crib width a may correspond to the usual distance between wooden ties 2, in which case the tamping picks are held in the position shown in full lines, while a larger crib width b indicates the distance between concrete ties, in which case the tamping picks are held in the position shown in phantom lines. Obviously, the tamping picks may be adjusted to any desired position.

In the embodiment illustrated in FIG. 2, guide 12 is shown as a dovetailed guide 15, with screws 14 tightened to hold tamping pick carrier 11 in position by friction.

As shown in FIG. 3, marks 16, 17 may be applied to tamping tool lever 4 as well as to tamping pick carrier 11 to enable a rapid and accurate positioning of tamping pick 10 according to linear scale 18. When markers 16 are in registry, the tamping picks are adjusted to crib width a between wooden ties while the adjustment corresponds to crib width b between concrete ties when markers 17 are in registry. Linear scale 18 on tamping tool lever 4 makes it possible to make any desired adjustment without time-consuming measurements.

FIG. 6 illustrates an embodiment in which the displacement of tamping pick carrier 11 is accomplished by rotating a threaded spindle 19.

What is claimed is:

1. A tamping tool unit for tamping ballast under a respective one of a succession of ties of a railroad track, which comprises (a) a frame extending in a longitudinal direction, (b) a pair of tamping tool levers mounted on the frame for pivoting about pivot axes in a plane extending in the longitudinal direction, (c) a reciprocating drive connected to each tamping tool lever for pivoting the tamping tool lever, (d) a tamping pick at a lower end of each tamping tool lever, (e) a substantially horizontally extending guide on at least one of the tamping tool levers for displacing the tamping pick in a direction extending substantially in the longitudinal direction and perpendicularly to the pivot axis of the at least one tamping tool lever, and (f) a fixing device for fixing the tamping pick on the lower tamping tool lever end.

2. The tamping tool unit of claim 1, wherein the fixing device comprises screws extending in the direction of the pivot axis.

3. A tamping tool unit for tamping ballast under a respective one of a succession of ties of a railroad track, which comprises (a) a frame extending in a longitudinal direction, (b) a pair of tamping tool levers mounted on the frame for pivoting about pivot axes in a plane extending in the longitudinal direction, (c) a reciprocating drive connected to each tamping tool lever for pivoting the tamping tool lever, (d) a tamping pick at a lower end of each tamping tool lever, (e) a tamping pick carrier on at least one of the tamping tool levers and displaceable along a substantially horizontally extending guide relative to the at least one tamping tool lever in a direction extending substantially in the longitudinal direction and perpendicularly to the pivot axis of the at least one tamping tool lever, and (f) a fixing device for fixing the tamping pick on the lower tamping tool lever end.

4. The tamping tool unit of claim 3, wherein the fixing device comprises screws extending in the direction of the pivot axis.

* * * * *